US008918022B2

(12) United States Patent
Iijima

(10) Patent No.: US 8,918,022 B2
(45) Date of Patent: Dec. 23, 2014

(54) DRIVING FORCE TRANSMISSION DEVICE, AND IMAGE FORMING APPARATUS

(71) Applicant: Fuji Xerox Co., Ltd., Tokyo (JP)

(72) Inventor: Chihiro Iijima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/863,582

(22) Filed: Apr. 16, 2013

(65) Prior Publication Data

US 2014/0126932 A1 May 8, 2014

(30) Foreign Application Priority Data

Nov. 8, 2012 (JP) ..... 2012-246683

(51) Int. Cl.
*G03G 15/00* (2006.01)
*G03G 15/01* (2006.01)

(52) U.S. Cl.
CPC ..... *G03G 15/757* (2013.01); *G03G 15/0189* (2013.01); *G03G 2215/0132* (2013.01)
USPC ..... 399/167

(58) Field of Classification Search
USPC ..... 399/167
See application file for complete search history.

(56) References Cited

U.S. PATENT DOCUMENTS 5,235,389 A * 8/1993 Kikuchi et al. ..... 399/263

FOREIGN PATENT DOCUMENTS

| | | |
|---|---|---|
| JP | A-07-293642 | 11/1995 |
| JP | A-2001-304349 | 10/2001 |
| JP | A-2007-239910 | 9/2007 |

* cited by examiner

*Primary Examiner* — David Bolduc
*Assistant Examiner* — Barnabas Fekete
(74) *Attorney, Agent, or Firm* — Oliff PLC

(57) ABSTRACT

Provided is a driving force transmission device including a sun gear that rotates by receiving a driving force from a driving source, an internal gear that is arranged coaxially with the sun gear, a planetary gear that engages with the sun gear and the internal gear, a rotary member that is provided coaxially with the sun gear and the internal gear and installed with the planetary gear so as to rotate corresponding to revolution of the planetary gear, and an urging member that urges the planetary gear toward the rotary member.

4 Claims, 7 Drawing Sheets

DRIVING FORCE TRANSMISSION DEVICE, AND IMAGE FORMING APPARATUS

CROSS-REFERENCE TO RELATED APPLICATIONS

This application is based on and claims priority under 35 USC 119 from Japanese Patent Application No. 2012-246683 filed Nov. 8, 2012.

BACKGROUND

Technical Field

The present invention relates to a driving force transmission device, and an image forming apparatus.

SUMMARY

According to an aspect of the invention, there is provided a driving force transmission device including: a sun gear that rotates by receiving a driving force from a driving source; an internal gear that is arranged coaxially with the sun gear; a planetary gear that engages with the sun gear and the internal gear; a rotary member that is provided coaxially with the sun gear and the internal gear and installed with the planetary gear so as to rotate corresponding to revolution of the planetary gear; and an urging member that urges the planetary gear toward the rotary member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail with reference to attached drawings.

Figure 1:
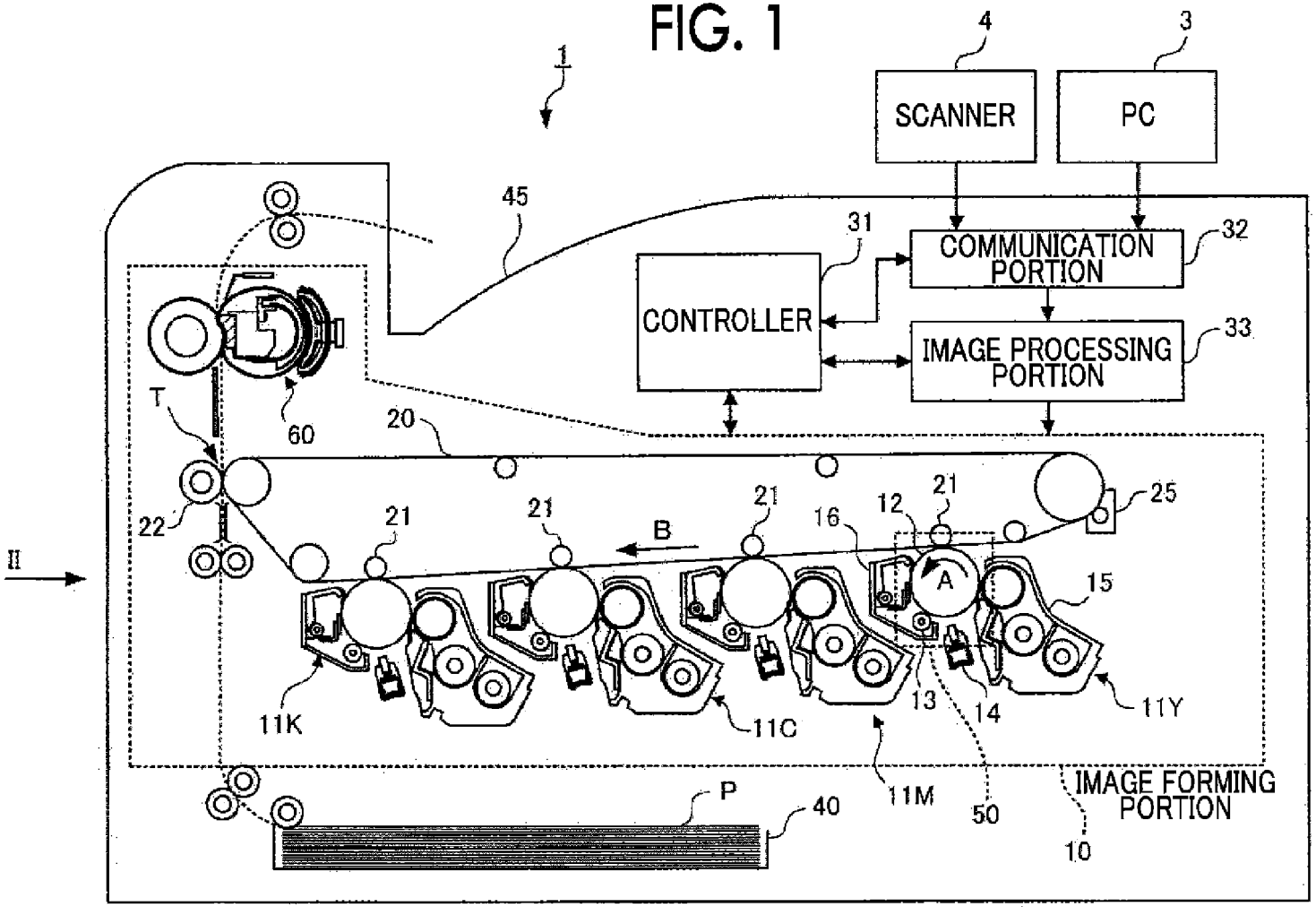
FIG. 1 shows a configuration example of an image forming apparatus according to an exemplary embodiment.

FIG. 1 shows a configuration example of an image forming apparatus according to the exemplary embodiment.

An image forming apparatus 1 shown in FIG. 1 is a so-called tandem-type color printer and includes an image forming portion 10 to perform an image forming based on image data and a controller 31 to control the entire operation of the image forming apparatus 1. In addition, the image forming apparatus 1 includes a communication portion 32 which communicates with a personal computer (PC) 3, an image reading apparatus (scanner) 4 or the like and receives image data, and an image processing portion 33 which executes a predetermined imaging process with respect to the image data received from the communication portion 32.

The image forming portion 10 includes four image forming units 11Y, 11M, 11C and 11K (also, generically called "image forming unit 11") arranged in parallel at constant intervals. Each image forming unit 11 includes a photosensitive drum 12 which functions as an image holding member to hold a toner image, and a driving mechanism 50 which is installed on a back side (rear side in FIG. 1) of the image forming apparatus 1 and performs rotational driving of the photosensitive drum 12. The driving mechanism 50 is constituted of a motor (described below) which generates a rotational driving force and a driving force transmission device which includes a planetary gear or the like and transmits the rotational driving force from the motor to the photosensitive drum 12. The description thereof will be followed in detail.

Also, each image forming unit 11 includes a charger 13 to charge a surface of the photosensitive drum 12 to a predetermined potential, a LED (Light Emitting Diode) print head 14 to expose the photosensitive drum 12, which is charged by the charger 13, based on the image data of each color, a developer 15 to develop an electrostatic latent image formed on the photosensitive drum 12, and a drum cleaner 16 to clean the surface of the photosensitive drum 12 after transfer. In this case, each of the image forming units 11 has the same configuration except for a toner stored in the developer 15, and forms a toner image of yellow (Y), magenta (M), cyan (C) or black (K).

Furthermore, the image forming portion 10 includes an intermediate transfer belt 20 on which the toner image of each color formed at the photosensitive drum 12 of each image forming unit 11 is multi-transferred, and a primary transfer roll 21 to successively transfer (primarily transfer) the toner image of each color, which is formed at each image forming unit 11, to the intermediate transfer belt 20. Also, image forming portion 10 includes a secondary transfer roll 22 to collectively transfer (secondarily transfer) the toner image of each color, which is superposed and transferred on the intermediate transfer belt 20, to a paper P as a recording material, and a fixing unit 60 to fix the toner image of each color transferred secondarily on the paper P.

In the image forming apparatus 1 according to the exemplary embodiment, image forming processes described below are performed under the operation control by the controller 31. In other words, the image data from the PC 3 or the scanner 4 is received by the communication portion 32. Subsequently, the image processing portion 33 carries out a predetermined imaging process so as to make the image data to be converted into the image data of each color, and then, the image data of each color are sent to each image forming unit 11.

Furthermore, in, for example, the image forming unit 11Y to form a toner image of a yellow (Y) color, the photosensitive drum 12 is rotated in a direction of arrow A by the driving mechanism 50, and the photosensitive drum 12 is charged to the predetermined potential by the charger 13. In addition, the LED printer head 14 causes the photosensitive drum 12 to be scanned and exposed based on the image data of the yellow color sent from the image processing portion 33. Thereby, an electrostatic latent image of the yellow-color image is formed on the photosensitive drum 12. The yellow-color electrostatic latent image formed on the photosensitive drum 12 is developed by the developer 15, whereby a yellow-color toner image is formed on the photosensitive drum 12. By the same manner, a toner image of magenta (M), cyan (C) or black (K) color is formed in the image forming unit 11M, 11C or 11K.

The toner image of each color formed on the photosensitive drum 12 of each image forming unit 11 is successively electrostatically transferred (primarily transferred) on the intermediate transfer belt 20, which moves in a direction of arrow B, by the primary transfer roll 21. Thereby, a superposed toner image made by superposing the toner of each color is formed. Corresponding to the movement of the intermediate transfer belt 20, the superposed toner image on the intermediate transfer belt 20 is transported to an area (secondary transfer portion T) in which the secondary transfer roll 22 is disposed. When the superposed toner image is transported to the secondary transfer portion T, the paper P is supplied from a paper holding portion 40 to the secondary transfer portion T so as to be matched with the transport timing. Then, the superposed toner image is collectively electrostatically transferred (secondarily transferred) on the transported paper P by transfer electric field which is formed in the secondary transfer portion T by the secondary transfer roll 22.

Thereafter, the paper P on which the superposed toner image is electrostatically transferred is transported to the fixing unit 60. The toner image on the paper P transported to the fixing unit 60 is heated and pressurized by the fixing unit 60, whereby fixed on the paper P. Subsequently, the paper P on which a fixed image is formed is transported to a paper stacking section 45 provided in a discharge portion of the image forming apparatus 1.

In addition, a toner (primary transfer remaining toner) adhered onto the photosensitive drum 12 after the primary transfer and a toner (secondary transfer remaining toner) adhered onto the intermediate transfer belt 20 after the secondary transfer are respectively removed by a drum cleaner 16 and a belt cleaner 25.

In this way, the image forming process in the image forming apparatus 1 is repeatedly executed as many cycles as the number of papers to be printed.

Description of Driving Mechanism 50

Figure 2:
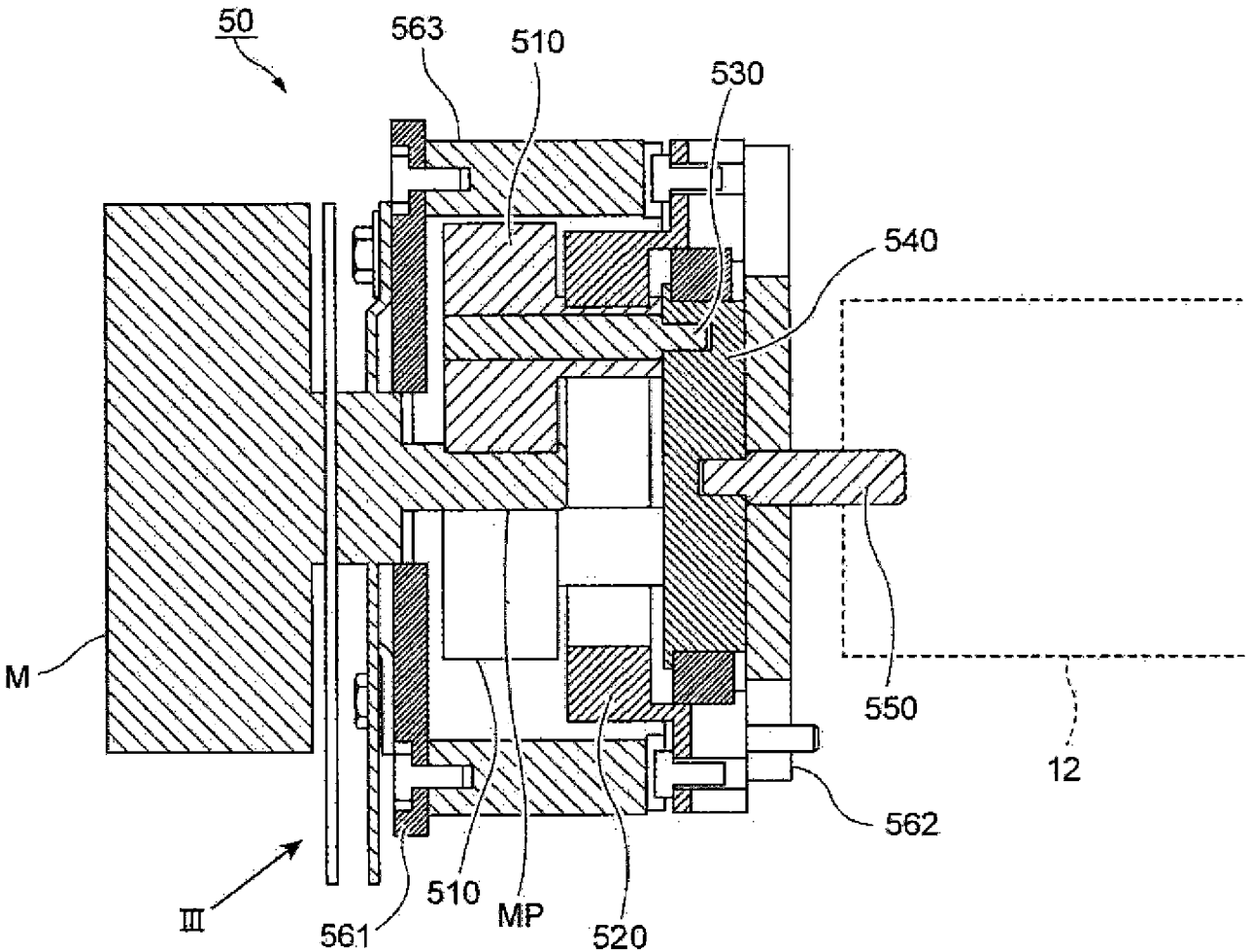
FIG. 2 is a cross-sectional view of a driving mechanism.

FIG. 2 is a cross-sectional view of the driving mechanism 50. More specifically, FIG. 2 shows a cross-sectional view of the driving mechanism 50 seen from a direction of arrow II in FIG. 1.

As shown in FIG. 2, the driving mechanism 50 according to the exemplary embodiment is provided with a motor M as an example of a driving source and a motor pinion MP functioning as a sun gear rotated by the motor M. In addition, three planetary gears 510 (two planetary gears 510 are shown in FIG. 2) which are disposed around the motor pinion MP and arranged in a state of engaging with the motor pinion MP are provided in the driving mechanism 50. Also, the planetary gear 510 is formed of POM (polyoxymethylene, polyacetal), for example.

Furthermore, an internal gear 520 arranged coaxially with the motor pinion MP is provided in the driving mechanism 50. In this case, the internal gear 520 is formed in a circular ring shape and formed with gears on an inner circumferential surface thereof. Also, the internal gear 520 is disposed on an external side of the three planetary gears 510 so as to engage with the three planetary gears 510. Furthermore, three (only one of them is shown in FIG. 2) support shafts 530 are provided in the driving mechanism 50 so as to correspond to the three planetary gears 510. Also, the support shafts 530 are provided so as to respectively penetrate shaft centers of the planetary gears 510, and rotatably support the planetary gears 510.

Still further, a rotating disk (carrier) 540 arranged coaxially with the motor pinion MP and the internal gear 520 is provided in the driving mechanism 50. In this case, the rotating disk 540 functioning as a rotary member rotates around a central portion in a radial direction thereof as a center. Furthermore, the support shafts 530 described above are installed in the rotating disk 540. In the exemplary embodiment, the support shafts 530 are supported by the rotating disk 540. In addition, a transmission shaft 550 which is installed in the central portion in the radial direction of the rotating disk 540 and transmits a rotational driving force from the rotating disk 540 to the photosensitive drum 12 is provided in the driving mechanism 50 according to the exemplary embodiment.

In addition, a first plate member 561 which supports the motor M and a second plate member 562 which is disposed at a position opposing to the first plate member 561 and arranged in a state of being spaced apart from the first plate member 561 are provided in the driving mechanism 50. In this case, the motor pinion MP, the planetary gear 510, the internal gear 520, the support shafts 530 and the rotating disk 540 described above are arranged between the first plate member 561 and the second plate member 562. Furthermore, a cylindrical-shaped housing member 563 to house the motor pinion MP, the planetary gear 510, the internal gear 520, the support shafts 530 and the rotating disk 540 therein is provided between the first plate member 561 and the second plate member 562.

In this case, when the photosensitive drum 12 is rotated by the driving mechanism 50, first, the motor M is driven, and therefore, the motor pinion MP is rotationally driven. Subsequently, if the motor pinion MP is rotationally driven, the three planetary gears 510 respectively rotate (self-rotate) around the shaft centers thereof as a rotational center. In addition, since each of the three planetary gears 510 engages with the internal gear 520, the planetary gears 510 perform (perform revolution) a circular movement around, as a center, a location in which the motor pinion MP is provided.

Next, if the three planetary gears 510 start the circular movement, the support shafts 530 also perform a circular movement around, as a center, the location in which the motor pinion MP is provided. Corresponding to the movement, the rotating disk 540 starts the rotation. Then, if the rotating disk 540 starts rotating, the transmission shaft 550 starts rotating, and therefore, the photosensitive drum 12 rotates. In the driving mechanism 50 according to the exemplary embodiment, the revolution speed of the transmission mechanism 50 is smaller than in the motor M, and thus, the driving mechanism 50 functions as a speed reduction mechanism.

Figure 3:
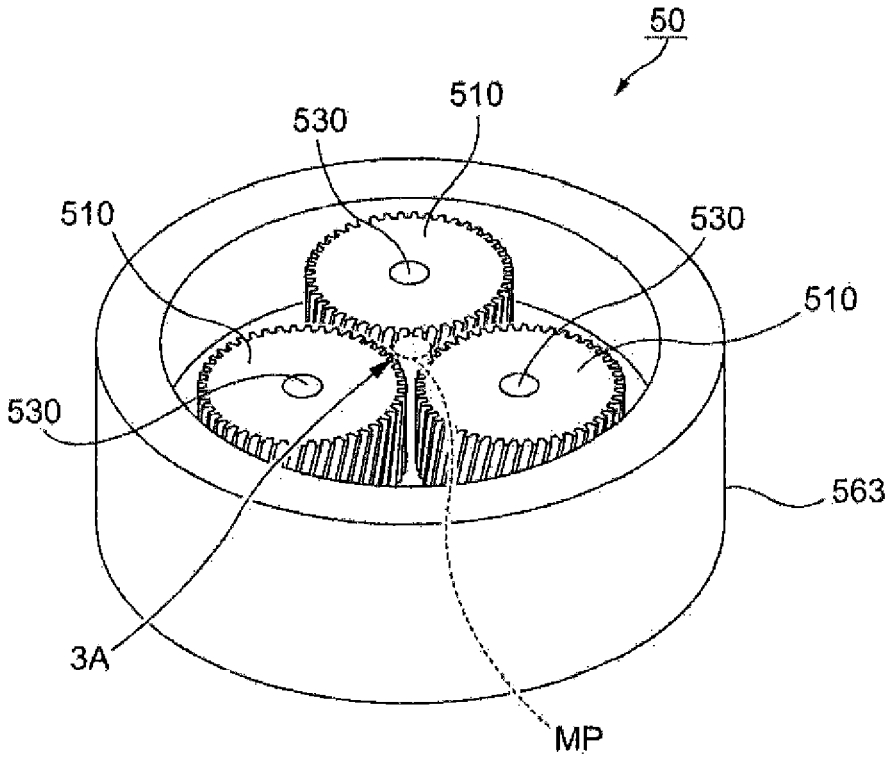
FIG. 3 shows the driving mechanism seen from a direction of arrow III in FIG. 2.

FIG. 3 shows the driving mechanism 50 seen from a direction of arrow III in FIG. 2. Also, FIG. 3 shows a state where the motor M, the motor pinion MP, the first plate member 561 is removed.

As shown in FIG. 3, the three planetary gears 510 and the support shafts 530 which are provided so as to respectively correspond to the three planetary gears 510 and rotatably support the planetary gears 510 are provided in the exemplary embodiment, as described above. In this case, although the description is omitted in the above, the three planetary gears 510 are respectively arranged at locations corresponding to apexes of an equilateral triangle.

Furthermore, the motor pinion MP shown in FIG. 2 is arranged (arranged at a location indicated by a reference sign 3A in FIG. 3) at a location corresponding to a center of the equilateral triangle, and also engages with all of the planetary gears 510. In addition, although the description is omitted in the above, each of the three planetary gears 510 is configured of a helical gear, and also, a tooth formed on an outer circumferential surface is inclined with respect to an axis direction of the planetary gear 510, as shown in FIG. 3. Incidentally, although not shown in the drawings, the motor pinion MP is also configured of a helical gear in order to engage with the planetary gear 510 configured of a helical gear.

Figure 4:
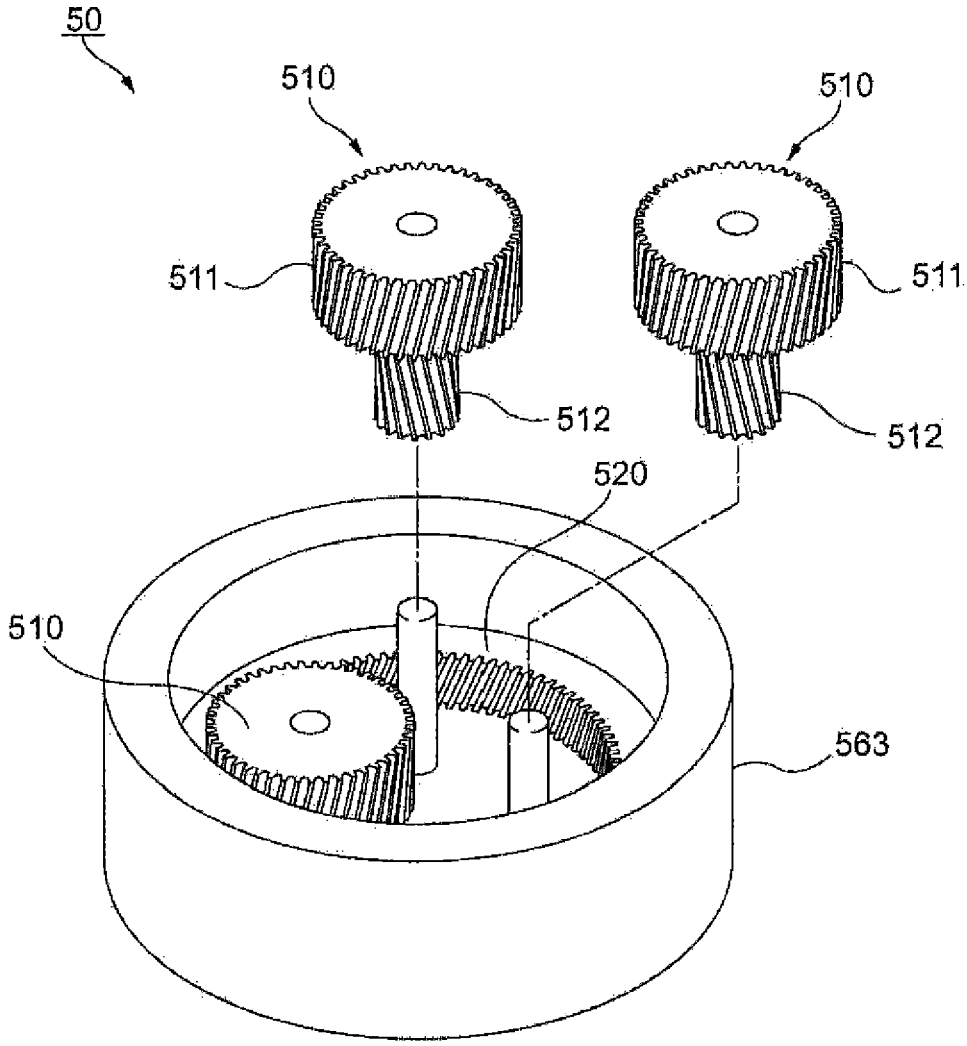
FIG. 4 shows a state where two planetary gears are removed in a state shown in FIG. 3.

FIG. 4 shows a state where two planetary gears 510 are removed in a state shown in FIG. 3.

Although the description is omitted in the above, the planetary gear 510 according to the exemplary embodiment includes a large-diameter portion 511 having a larger outer diameter and a small-diameter portion 512 having an outer diameter smaller than in the large-diameter portion 511. In the exemplary embodiment, the small-diameter portion 512 engages with an inner circumference surface of the internal gear 520, and the large-diameter portion 511 engages with the motor pinion MP.

Furthermore, in the exemplary embodiment, both of the large-diameter portion 511 and the small-diameter portion 512 are configured of a helical gear, and also, the internal gear 520 is configured of a helical gear. In addition, an extending direction (helix direction) of the tooth formed on the outer circumferential surface of the large-diameter portion 511 is different (reversed against) from an extending direction (helix direction) of the tooth formed on the outer circumferential surface of the small-diameter portion 512 in the exemplary embodiment.

Meanwhile, if helical gears are adopted as in the exemplary embodiment, a thrust force (axial force) which causes the helical gear to be moved in an axis direction of the helical gear acts on each helical gear. In this case, in the driving mechanism 50 according to the exemplary embodiment, thrust forces indicated by arrows F1 to F5 in FIG. 5 (drawing which shows thrust forces acting on each of gears provided in the driving mechanism 50) respectively act on the motor pinion MP, the planetary gear 510, the internal gear 520. In more detail, in the exemplary embodiment, the helix direction and the helix angle of the tooth formed on the outer circumferential surface of each helical gear are adjusted in advance such that the thrust forces in directions of the arrows F1 to F5 respectively act on the motor pinion MP, the planetary gear 510 and the internal gear 520.

More specifically, the thrust force F1 (thrust force F1 which urges the motor pinion MP in a direction of being separated from the motor M) which causes the motor pinion MP to be pulled away from the motor M acts on the motor pinion MP. Therefore, in the exemplary embodiment, the motor pinion MP is pulled in the same direction with an acting direction of pre-load which is applied to a rolling ball bearing (ball bearing, not shown) provided in the motor M. Thereby, upon comparison with a case where the thrust force F1 acts in a direction opposite to the action direction of the pre-load, noise and vibration are suppressed.

Meanwhile, the thrust force F2 which causes the planetary gear 510 to be moved in a first plate member 561 side (motor M side) acts on the large-diameter portion 511 of the planetary gear 510. In more detail, the thrust force F2 (second axial force) which urges the planetary gear 510 in a direction of being separated from the rotation disk 540 acts on the planetary gear 510. More specifically, in the exemplary embodiment, the thrust force F1 which causes the motor pinion MP to be pulled away from the motor M is imparted from the planetary gear 510 to the motor pinion MP. As a result, the thrust force F2 which urges the planetary gear 510 in a direction of being separated from the rotating disk 540 counteractively acts on the planetary gear 510.

Still further, in the exemplary embodiment, the small-diameter portion 512 of the planetary gear 510 engages with the internal gear 520, whereby the thrust force F3 which causes the planetary gear 510 to be moved in a direction of being separated from the first plate member 561 side (motor M side) acts on each planetary gear 510. In more detail, the thrust force F3 (first axial force) which urges the planetary gear 510 towards the rotating disk 540 acts on each planetary gear 510. In addition, the thrust force F4 which causes the internal gear 520 to be moved to the first plate member 561 side (motor M side) counteractively acts on the internal gear 520.

Furthermore, in the exemplary embodiment, the thrust force F3 acting on the small-diameter portion 512 of the planetary gear 510 is set to be stronger than the thrust force F2 acting on the large-diameter portion 511 of the planetary gear 510. In more detail, the motor pinion MP, the planetary gear 510 and the internal gear 520 is designed in advance such that the thrust force F3 is stronger than the thrust force F2. As a result, in the exemplary embodiment, the thrust force indicated by the arrow F5 in FIG. 5 acts on each of the planetary gears 510, and therefore, each of the planetary gears 510 is pushed (urged) in a rotating disk 540 side.

Figure 6:
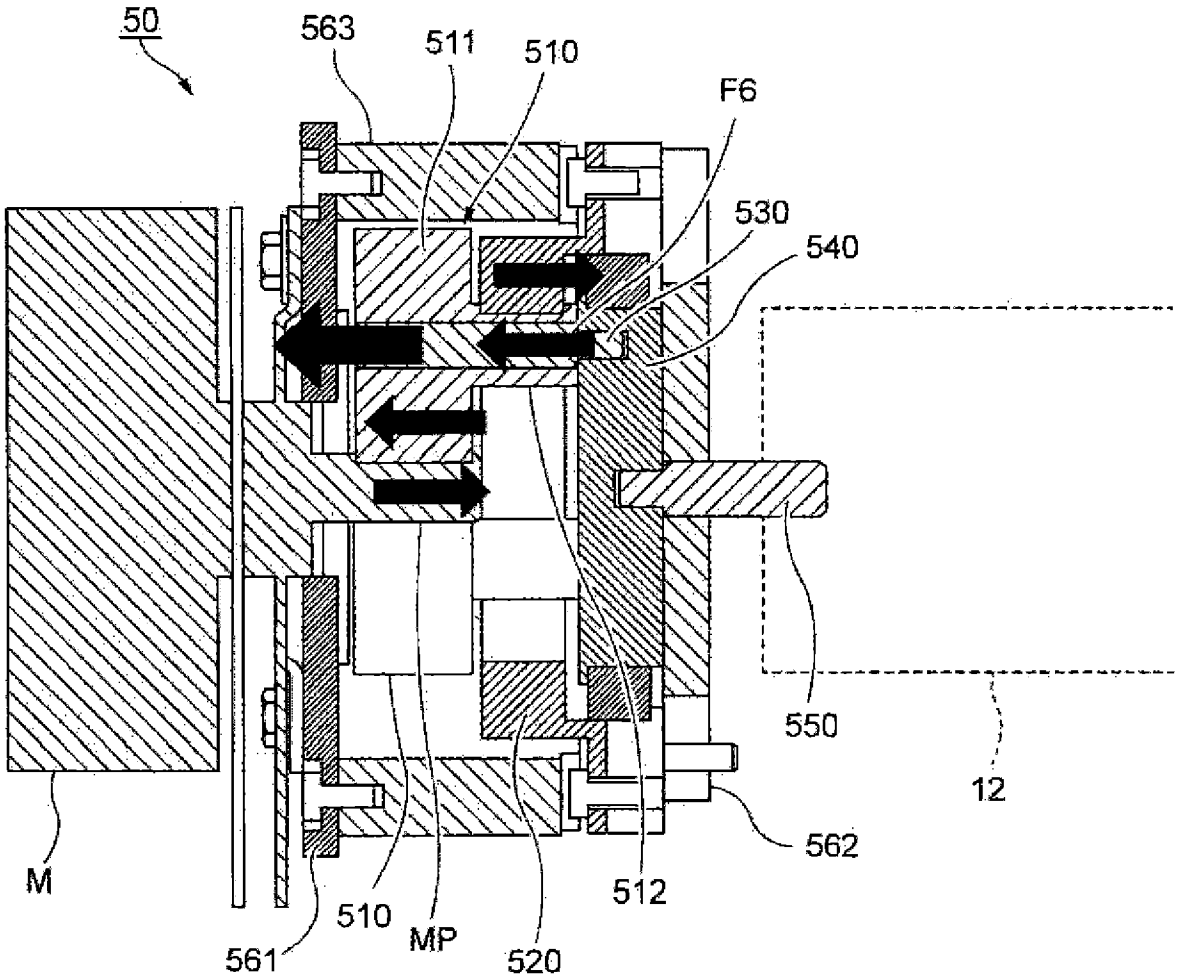
FIG. 6 shows a comparative example of the driving mechanism.

FIG. 6 shows a comparative example of the driving mechanism 50.

In a helical gear, an action direction of a thrust force is changed depending on an inclined direction of a tooth formed on an outer circumferential surface thereof. In this case, for example, if an inclined direction of a tooth formed on an outer circumferential surface of the small-diameter portion 512 of the planetary gear 510 and an inclined direction of a tooth formed on an inner circumference surface of the internal gear 520 is designed to be reversed to the inclined direction in the exemplary embodiment, a thrust force which urges the planetary gear 510 toward the first plate member 561 acts on the small-diameter portion 512 of the planetary gear 510, as indicated by the arrow F6 in FIG. 6. In such a case, each of the planetary gears 510 is pushed to the first plate member 561 side.

Meanwhile, each of the planetary gears 510 revolves around, as a center, the location in which the motor pinion MP is provided, as described above. Therefore, when the planetary gears 510 are pushed to the first plate member 561 side, a drag force acts on each of the planetary gears 510 during the revolution of each planetary gear 510. In this case, there is a possibility that the rotational accuracy of the photosensitive drum 12 may be deteriorated. Also, if such a drag force acts on the planetary gear 510, it is likely that a life span thereof is shortened by frictional wear.

Figure 7:
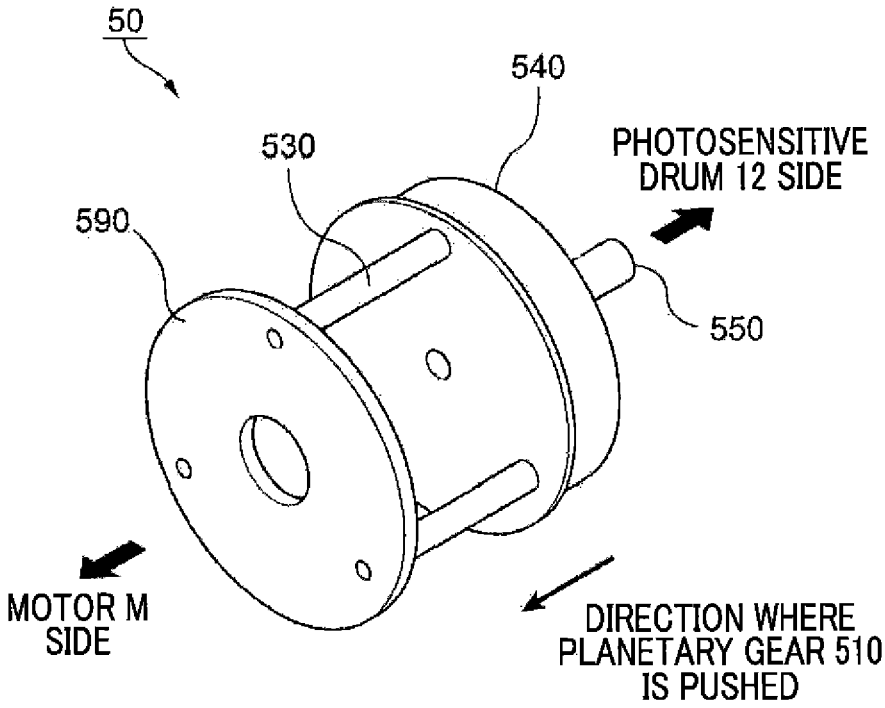
FIG. 7 shows a configuration example provided with a reduction member.

Furthermore, it is possible to reduce the drag force acting on the planetary gear 510 by providing a reduction member 590, which is formed of a resin or the like and reduces a sliding friction between the first plate member 561 (see FIG. 6) side and the planetary gear 510, on a side where the planetary gear 510 (not shown in FIG. 7) is pushed, as shown in FIG. 7 (drawing which shows the configuration example provided with a reduction member). However, in this case, the number of components is increased.

Figure 5:
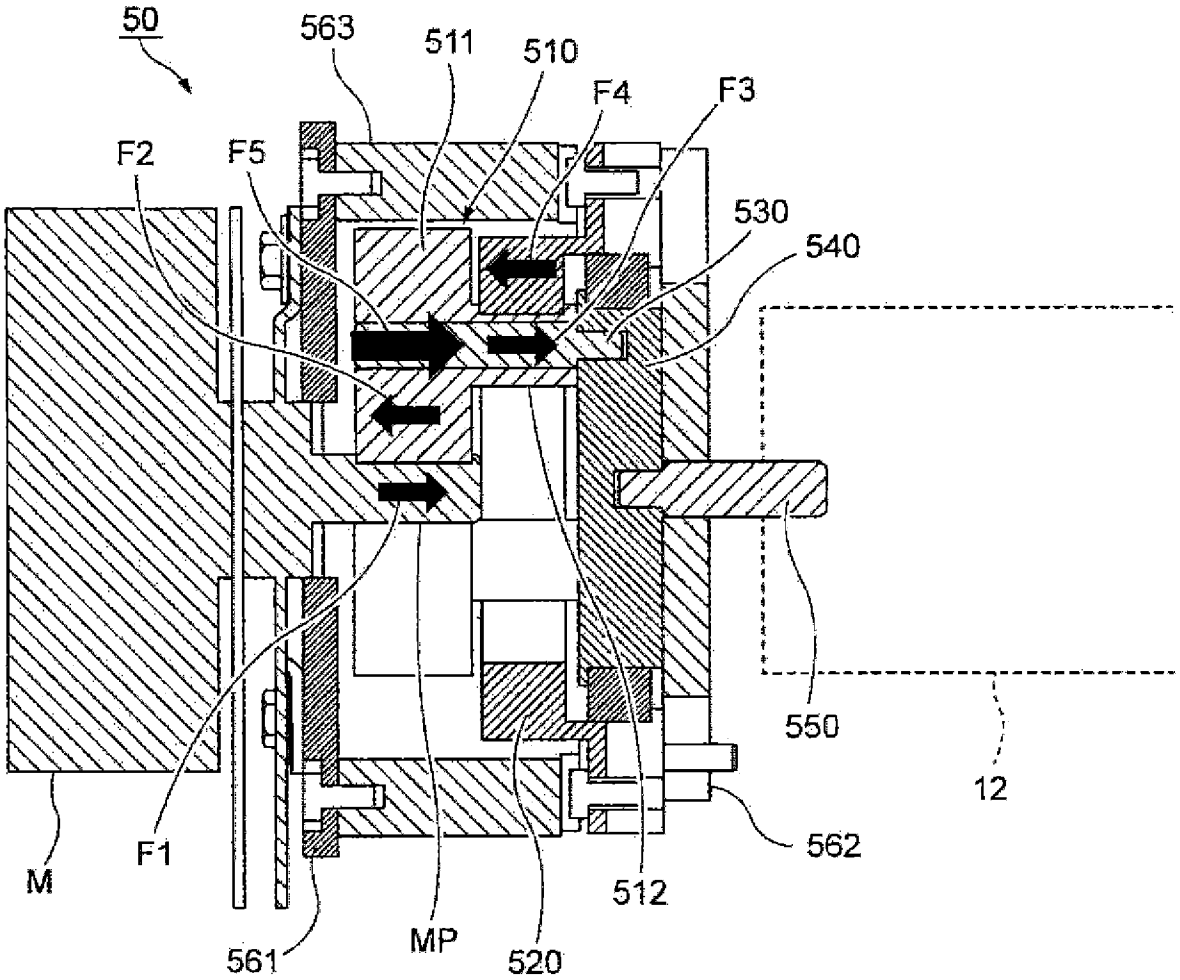
FIG. 5 shows a thrust force acting on each of gears provided in the driving mechanism.

On the other hand, in the configuration according to the exemplary embodiment, each of the planetary gears 510 is pushed to the rotating disk 540 moving with the planetary gears 510, as described in FIG. 5. As a result, in the exemplary embodiment, the drag force acting on the planetary gear 510 is reduced. In more detail, the configuration of the exemplary embodiment is the same with the configuration of the comparative example in that a drag force acts on the planetary gear 510 during self-rotation of the planetary gear 510. However, during the revolution of the planetary gear 510, a drag force acting on the planetary gear 510 in the exemplary embodiment is smaller than in the comparative example.

In addition, in the case of the exemplary embodiment, the planetary gear 510 is pushed to the rotating disk 540, whereby frictional wear is caused between the planetary gear 510 and the rotating disk 540 as well. In this case, if a pushing force of the planetary gear 510 with respect to the rotating disk 540 is extremely large, there is possibility that a life span of the device may be affected by progression of the frictional wear.

Therefore, in the exemplary embodiment, the pushing force of the planetary gear 510 with respect to the rotating disk 540 is regulated not to be excessive by adjusting the inclination angle (helix angle) of the tooth formed on the outer circumferential surface of the small-diameter portion 512 of the planetary gear 510 and the inclination angle (helix angle), the tooth formed on the inner circumference surface of the internal gear 520 or the like. More specifically, a PV value between the planetary gear 510 and the rotating disk 540 (load pressure X rotational velocity) is set to be equal to or smaller than a limit PV value. Thereby, the life span of the device is prevented from being shortened.

Furthermore, although the driving mechanism 50 is used for rotationally driving the photosensitive drum 12 in the above description, the driving mechanism 50 may be used for rotationally driving other parts. For example, the driving mechanism 50 may be used to a transport roll to transport the paper P or a drive roll to rotationally drive the intermediate transfer belt 20. In addition, a case where the driving mechanism 50 is used for driving a part of the image forming apparatus 1 is exemplified in the exemplary embodiment. However, without being limited to the image forming apparatus 1, the driving mechanism 50 may be used for driving a rotary member provided in other devices.

Still further, the urge of the planetary gear 510 against the rotating disk 540 is carried out by using the inclination of the tooth formed on the helical gear, in the above description. However, the urge of the planetary gear 510 against the rotating disk 540 may be carried out by using an urging member such as a spring.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving force transmission device comprising:

a sun gear that rotates by receiving a driving force from a driving source;

an internal gear that is arranged coaxially with the sun gear;

a planetary gear that engages with the sun gear and the internal gear;

a rotary member that is provided coaxially with the sun gear and the internal gear and installed with the planetary gear so as to rotate corresponding to revolution of the planetary gear; and an urging member that urges the planetary gear toward the rotary member, wherein the planetary gear and the internal gear are configured of helical gears, and the planetary gear is urged toward the rotary member by an axial force generated by the engagement between the planetary gear and the internal gear.

2. The driving force transmission device according to claim 1, wherein the driving source is disposed on an opposite side to the rotary member interposing the sun gear therebetween and configured of a motor;

wherein the sun gear and the planetary gear are configured of helical gears; and wherein the sun gear is urged in a direction away from the motor by an axial force generated by the engagement between the sun gear and the planetary gear.

3. The driving force transmission device according to claim 1, wherein the sun gear, the planetary gear and the internal gear are configured of helical gears, wherein the driving source is disposed on an opposite side to the rotary member interposing the sun gear therebetween and configured of a motor, wherein a first axial force that urges the planetary gear toward the rotary member by the engagement between the planetary gear and the internal gear acts on the planetary gear, wherein a second axial force that urges the planetary gear in a direction away from the rotary member by the engagement between the sun gear and the planetary gear acts on the planetary gear, and wherein the first axial force is set to be greater than the second axial force, and an axial force that urges the sun gear in a direction away from the motor acts on the sun gear as a counteraction of the second axial force.

4. An image forming apparatus comprising:

an image holding member that holds a formed image;

a driving source that is used for rotationally driving the image holding member; and a driving force transmission device that transmits a driving force from the driving source to the image holding member, wherein the driving force transmission device according to claim 1 is used as the driving force transmission device.

* * * * *